United States Patent [19]

LeBegue et al.

[11] 4,088,371

[45] May 9, 1978

[54] BOOM STABILIZER FOR AN UNDERGROUND MINING MACHINE

[75] Inventors: Maurice K. LeBegue, Argillite; Charles R. Herron, Russell, both of Ky.

[73] Assignee: National Mine Service Company, Pittsburgh, Pa.

[21] Appl. No.: 764,632

[22] Filed: Feb. 1, 1977

[51] Int. Cl.[2] ..... E21C 27/24

[52] U.S. Cl. ..... 299/76; 299/64

[58] Field of Search ..... 299/64, 76, 75, 1

[56] References Cited

U.S. PATENT DOCUMENTS

| | | | |
|---|---|---|---|
| 2,659,586 | 11/1953 | Leven | 299/75 X |
| 2,707,099 | 4/1955 | Daily | 299/75 X |

FOREIGN PATENT DOCUMENTS

| | | | |
|---|---|---|---|
| 1,758,161 | 1/1971 | Germany | 299/76 |

*Primary Examiner*—Ernest R. Purser

*Attorney, Agent, or Firm*—Stanley J. Price, Jr.; John M. Adams

[57] ABSTRACT

A continuous mining machine is propelled on endless crawler tracks and includes a body portion with a boom extending forwardly therefrom. The boom rotatably supports a drum having peripherally extending cutting elements. A boom stabilizer mounted on the boom includes a plate member pivotally connected at one end to the boom rearward of the drum. A piston cylinder assembly is pivotally mounted on the boom member and includes an extensible piston rod that is pivotally connected to the opposite end of the plate member. Extension of the piston rod pivots the plate member upwardly to a preselected height where the plate upper surface lies on a line tangent to the cutting path of the cutting elements at the top of the drum. When the drum is positioned adjacent the mine roof for sumping into the mine face, the stabilizing plate abuts the mine roof with the cutting elements displaced from the mine roof. As the drum is sumped forward the stabilizing plate prevents the drum from climbing the face into the mine roof. Thus, the drum drive motors are not overloaded by the drum simultaneously cutting the mine roof and face, and a preselected mine roof height is maintained during the mining operation.

9 Claims, 4 Drawing Figures

BOOM STABILIZER FOR AN UNDERGROUND MINING MACHINE

BACKGROUND OF THE INVENTION

1. Field of the Invention

This invention relates to a boom stabilizer for an underground mining machine and more particularly to a stabilizing plate pivotally mounted on the boom of a mining machine and operable to be raised to a preselected position to abut the mine roof when the material dislodging apparatus is positioned adjacent the mine roof for sumping into the mine face to prevent the cutting elements from engaging the mine roof.

2. Description of the Prior Art

Mining machines, for example as illustrated in U.S. Pat. No. 3,730,593, are utilized in underground mining operations to continuously dislodge solid mineral material from the face of the mine shaft. Generally, a boom member extends forwardly from an elongated body portion of the mining machine that is propelled through the mine on endless crawler tracks. The boom member is pivotally connected to the mining machine body portion and rotatably supports a material dislodging apparatus, such as a drum member having peripherally extending cutting elements. The drum member extends transversely to the longitudinal axis of the body portion and upon rotation the cutting elements dislodge solid material from the mine face. The drum member is raised to a preselected vertical height in the mine as determined by the thickness of the mineral vein. The drum member is rotated and sumped into the mine face with the drum member positioned adjacent the mine roof. Once the drum member has advanced into the mine face, the boom member is pivoted downwardly to move the drum member vertically downwardly through the face to make a shear cut in the face. The dislodged material is gathered by a gathering device which moves the dislodged material rearwardly onto a conveyor that extends longitudinally on the mining machine to transport material toward the rear of the mining machine.

In conducting the downward shear cut by the drum it is desired to maintain the peripheral cutting edge of the cutting elements disengaged from the mine roof so that the elements cut only the vertical mine face. Positioning the cutting elements in cutting relation with the mine roof and the mine face increases the load upon the motors that rotate the drum member when the drum member is sumped forwardly into the mine face adjacent the roof. Furthermore, if the drum member is permitted to dislodge material from the mine roof during the sumping operation an irregular roof surface results. An irregular roof surface presents considerable difficulty in the installation of mine roof bolts and other roof support apparatus.

The drum member has a tendency when raised to the vertical position adjacent the mine roof for the sumping operation to move upwardly or climb the mine face into the roof as the drum member is sumped inwardly. If the cutter elements engage both the mine roof and face during the sumping operation, an additional load is placed on the drum motors that may result in damage to the motors.

There is need in the operation of an underground mining machine to prevent cutting engagement of the material dislodging apparatus with the mine roof during the sumping operation adjacent the mine roof. The cutting elements of the material dislodging apparatus should be placed from cutting engagement with the mine roof and the material dislodging apparatus should be prevented from climbing upwardly into the roof during the sumping operation. Furthermore, there is need to prevent vertical movement of the material dislodging apparatus beyond a preselected vertical height during the sumping operation and thereby form a mine roof of a substantially uniform height and free of undulations.

SUMMARY OF THE INVENTION

In accordance with the present invention there is provided a boom stabilizer for an underground mining machine that includes a mobile body portion. A boom member is pivotally secured to the body portion and extends forwardly therefrom. A material dislodging apparatus is rotatably mounted on the front of the boom member. Cutting elements are secured to the material dislodging apparatus and extend outwardly therefrom. A stabilizing assembly is pivotally connected to the boom member adjacent to the material dislodging apparatus for engaging the roof of a mine to maintain the cutting elements displaced from engaging the roof. An actuator mechanism is connected to the stabilizing assembly and is mounted on the boom member for raising the stabilizing assembly to a preselected height.

The actuator mechanism is operable upon actuation to pivot the stabilizing assembly on the boom member upwardly in a vertical arc to a preselected height above the boom member. Preferably, the stabilizing assembly is positioned above the boom member at a height to prevent the circular cutting path of the material dislodging apparatus from intersecting the roof when the stabilizing assembly is positioned in abutting relation with the mine roof and the material dislodging apparatus is sumped into the mine face. The actuator mechanism maintains the stabilizing assembly in abutting relation with the mine roof so that the material dislodging apparatus does not engage the mine roof during the inward sumping operation. Preferably, the roof engaging surface of the stabilizing assembly is maintained at a vertical height which is on a line tangent to the edge of the cutting elements opposite the mine roof. With the stabilizing assembly maintained in this position the cutting elements only dislodge material from the mine face and not the mine roof. This ensures a uniform mine roof height with the roof free of undulations which hinder the installation of roof support apparatus. Furthermore, the material dislodging apparatus is not subjected to additional loads during the sumping operation when the cutting elements simultaneously engage the mine roof and face.

The stabilizing assembly includes a plate member that extends rearwardly from the material dislodging apparatus and is pivotally connected at the forward end portion thereof to the boom member. The opposite end portion of the stabilizing plate is pivotally connected to the end portion of a piston rod extending from a piston cylinder assembly that comprises the actuator mechanism. The piston cylinder assembly is, in turn, pivotally connected to the boom member. With this arrangement extension of the piston rod from the assembly urges the cylinder and stabilizing plate to pivot upwardly. The degree of extension of the piston rod from the cylinder is determined by the maximum vertical height to which the boom member is to be raised. The stabilizing plate includes an arcuately shaped roof engaging surface. When the material dislodging apparatus is raised by the boom member to the desired height adjacent the mine roof for sumping into the mine face, the roof engaging surface of the stabilizing plate is positioned in abutting relation with the mine roof to prevent the material dislodging apparatus from climbing the mine face into the mine roof. The piston cylinder assembly maintains the plate extended. Preferably, the point where the roof engaging surface of the stabilizing plate contacts the mine roof lies on a line which is tangent to the cutting path of the cutting elements positioned opposite. This ensures that the cutting elements do not engage and dislodge mine material from the roof when the material dislodging apparatus is sumped into the mine face in preparation of a downward shear cut.

The vertical positioning of the stabilizing plate determines the vertical height to which the boom member raises the material dislodging apparatus and accordingly the height of the mine roof to be formed by the dislodging of material from the mine face. The height of the mine roof is, in turn, determined by the thickness of the mineral vein to be mined. Therefore, the boom stabilizer of the present invention functions to ensure that the material dislodging apparatus, prior to each downward shear cut, is raised to the same elevation. In this manner a uniform ceiling height is maintained during the mining operation. Also, by restraining the material dislodging apparatus from climbing the mine face into the mine roof, the drive motors for the material dislodging apparatus are not subjected to excessive loads that may result in overheating of the motors.

Accordingly the principal object of the present invention is to provide a boom stabilizer for an underground mining machine where the cutting elements of the mining machine are prevented from engaging the mine roof during the sumping operation adjacent the mine roof prior to making a downward shear cut.

A further object of the present invention is to provide on a continuous drum-type mining machine a boom stabilizer that is raised and lowered to a preselected height by a piston cylinder assembly which is operable to maintain the vertical position of the boom stabilizer as the boom stabilizer is advanced into contact with the mine roof by the upward pivoting of the boom member so that the drum is positioned adjacent the mine roof and the cutting elements engage only the mine face and not the roof as the drum is sumped into the face.

An additional object of the present invention is to provide a boom stabilizer that is pivotally mounted on the boom of a continuous mining machine and operable to be raised to a preselected elevation to engage the mine roof when the boom is raised to ensure that the boom is positioned at the same vertical height prior to making a downward shear cut.

These and other objects of the present invention will be more completely described and disclosed in the following specification, the accompanying drawings and the appended claims.

DESCRIPTION OF THE PREFERRED EMBODIMENT

Figure 1:
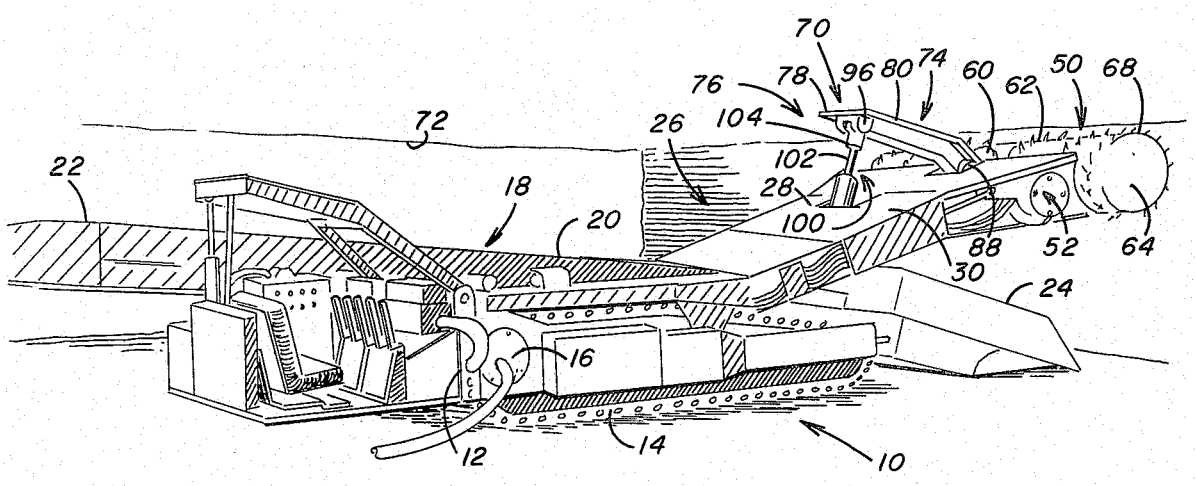
FIG. 1 is a prospective view of a continuous mining machine, illustrating a boom stabilizer in an extended position abutting the mine roof.
Figure 2:
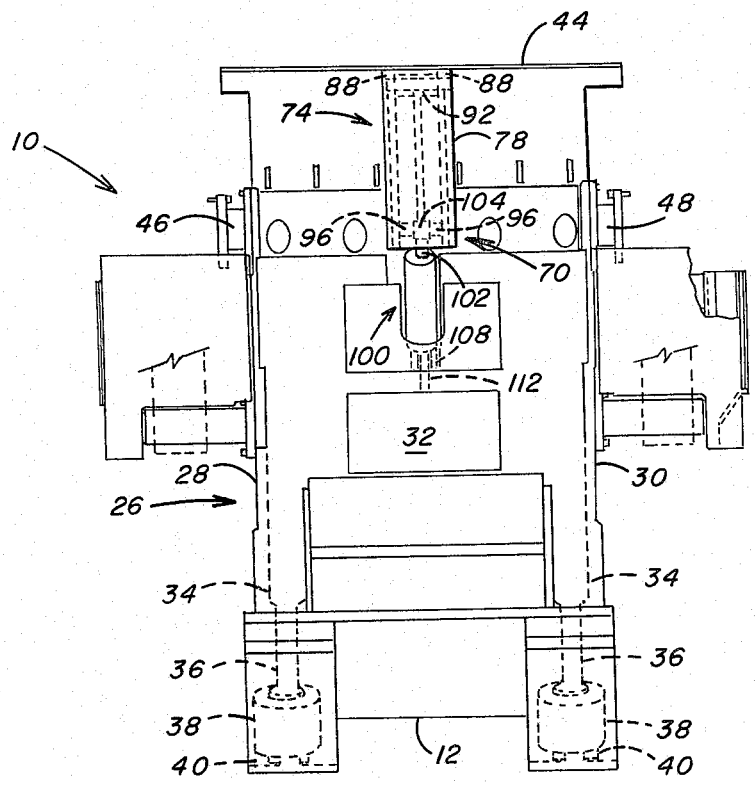
FIG. 2 is a top plan view of a mining machine boom illustrating the boom stabilizer pivotally connected at one end to the boom and at the opposite end to a piston cylinder assembly.
Figure 3:
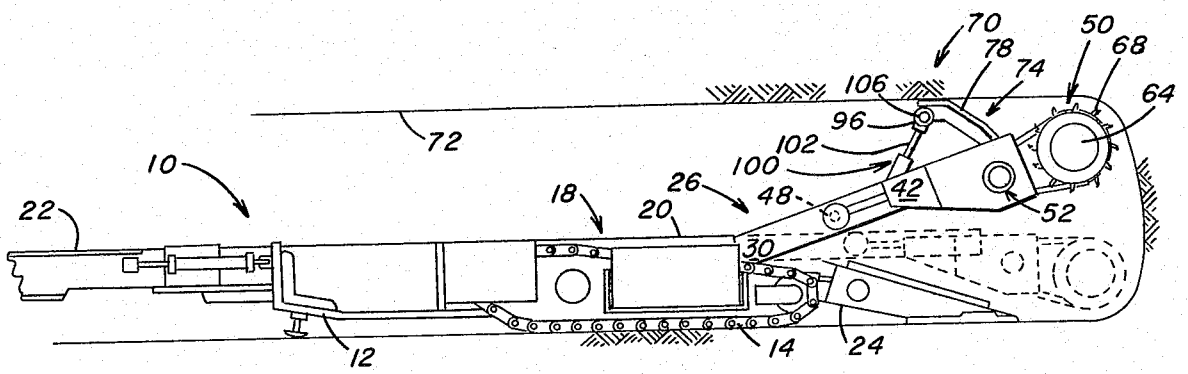
FIG. 3 is a view in side elevation of a mining machine similar to the machine illustrated in FIG. 1 with the boom in position to sump into the mine face adjacent the mine roof and the boom stabilizer abutting the mine roof to maintain the drum member cutting elements disengaged therefrom.

Referring to the drawings and particularly FIGS. 1, 2 and 3, there is illustrated a mining machine generally designated by the numeral 10 which is characteristic of a continuous mining machine used in the underground mining of minerals such as coal, potash and other minerals. U.S. Pat. No. 3,730,593 illustrates and described a continuous mining machine and is incorporated herein by reference. The mining machine 10 has a body or frame portion 12 suitable mounted on endless crawler tracks 14. Drive motors 16 are provided to propel the mining machine 10 on the endless crawler tracks 14 and advance the mining machine during the mining operation. An endless conveyor mechanism generally designated by the numeral 18 is positioned on a longitudinal trough member 20 and conveys dislodged material therein from the front of the mining machine to an articulated rear discharge section 22. As illustrated in FIGS. 1 and 3 a gathering device 24 extends forwardly from the body portion 12 and is arranged to gather the dislodged material and feed the dislodged material onto the conveyor trough 20 so that the dislodged material can be conveyed rearwardly by the conveyor mechanism on the mining machine to the discharge section 22.

A forwardly extending boom member generally designated by the numeral 26 has parallel rearwardly extending arm members 28 and 30 that are connected to each other adjacent the front end by means of a transverse housing 32. The arm members 28 and 30 are pivotally connected to the mining machine body portion 12 and are also pivotally connected at 34 to a piston rod 36 of the shear piston cylinder assembly 38. The shear piston cylinder assemblies 38 are, in turn, pivotally connected to the mining machine body 12 at 40. With this arrangement, extension and retraction of the piston rods 36 within the piston cylinder assemblies 38 pivot the boom member 26 about the arm member rear end portions and move the boom member 26 vertically to the position illustrated in FIG. 1 and in the position illustrated in solid lines in FIG. 3 for a downward shear cut of the mine face as illustrated in FIG. 3. The boom member 26 has a second pair of parallel arms or support members 42, only one of which is shown in FIG. 3. The arm members 42 are supported adjacent their rear end on stabilizer rods 46 and 48, as illustrated in FIGS. 2 and 3 that are secured to and extend laterally from the respective arm members 28 and 30 of boom 26.

As illustrated and described in greater detail in U.S. Pat. No. 3,730,593, the boom housing 32 includes a cylinder having piston rods fixed at one end to the arm members 42 and to pistons within the cylinder. By supplying hydraulic fluid under pressure to the cylinder, a force is exerted on the pistons to move the arm members 42 laterally relative to the arm members 28 and 30 to extend and retract a material dislodging apparatus, such as a rotatable member or a drum member generally designated by the numeral 50, illustrated in FIGS. 1 and 3. The dislodging apparatus 50 is not illustrated in FIG. 2, but it should be understood that it is positioned forwardly of the transverse forward edge 44 of the boom 26. Drum rotating motors generally designated by the numeral 52 in FIGS. 1 and 3 are secured to the laterally movable arm members 42 for lateral movement therewith. Motors 52 are connected through a clutch mechanism and planetary gear mechanism to a gear train to the drum member 50 to rotate the drum member and dislodge material from the mine face.

As illustrated in FIG. 1 the drum member 50 has a pair of intermediate sections 60 and 62 positioned adjacent each other, and a pair of canted end sections 64 (only one of which is shown) extend outwardly from the intermediate sections 60 and 62. An axial shaft member telescopically supports the intermediate sections. With this arrangement, the drum member 50 is operable to extend laterally as the arm members 42 move laterally to extend the drum member to a dimension greater than the width of the mining machine. Cutter bits, generally designated by the numeral 68, are secured to and extend angularly outwardly from the intermediate and end sections of the drum member 50 and are arranged so that, upon rotation of the drum member 50, the cutter bits dislodge material from the mine face. The cutter elements or bits 68 are preferably so positioned on the respective sections of the drum that during rotation substantially the entire mine face along the length of the drum member 50 at the line of tangency between the drum member and the face is subjected to the dislodging action of the bits 68. The material dislodging apparatus is not limited to the cutter drum member 50 of a continuous mining machine but may include other known rotatable members for supporting cutting elements. Reference is made to a cutter drum member 50 in the present invention only for the purposes of illustration and is not to be considered a limitation of the present invention as other known material dislodging apparatus for underground mining are equally suitable.

A boom stabilizer generally designated by the numeral 70 is pivotally supported on the boom member 26 to be raised to a preselected height as illustrated in FIGS. 1 and 3 to abut the mine roof and thereby prevent the cutter bits 68 from engaging the mine roof as the drum member 50 is sumped into the mine face adjacent the mine roof. Preferably, the boom stabilizer 70 is raised to a position where the upper surface thereof lies on a line tangent to the peripheral cutting edge of the cutter bits 68 at the top of the drum sections so that the cutter bits 68 remain displaced from cutting engagement with the mine roof 72, as illustrated in FIGS. 1 and 3, to prevent the drum member 50 from dislodging solid material from the mine roof. With this arrangement when the boom member 26 raises the drum member 50 to be preselected vertical height for sumping into the mine face to make a downward shear cut of the face, the bits 68 do not engage the mine roof. The bits 68 engage only the mine face to dislodge solid material therefrom. This prevents the drum 50 from climbing the mine face and undesirably cutting the roof, creating an uneven roof surface. An uneven roof surface presents considerable problems in the installation of roof support devices, such as beam members and roof bolts. In addition the drum motors 52 and 54 are subjected to additional stress tending to overload the motors when the drum member 50 engages the mine roof and face as it is sumped inwardly.

The boom stabilizer 70 includes a roof engaging assembly generally designated by the numeral 74 that is pivotally connected at one end to the boom member 26 adjacent the drum member 50 and at the opposite end to an actuator mechanism generally designated by the numeral 76. The actuator mechanism 76 is pivotally connected at one end portion to the rearward end portion of the roof engaging assembly 74 and is connected at the opposite end portion to the mining machine boom member 26. The actuator mechanism 76 is an extensible device so that, upon actuation, the roof engaging assembly 74 is pivoted upwardly to a preselected height which will determine the maximum height the boom member 26 raises the drum member 50. In this manner the boom member 50 is raised to the same vertical height for commencing inward sumping of the drum member 50 prior to the downward shear cut.

The vertical distance to which the drum member 50 may be raised is limited by the roof engaging assembly 74 abutting the mine roof 72. It will be apparent from the present invention that the extension of the actuator mechanism 76 for positioning the roof engaging assembly 74 in abutting relation with the mine roof to prevent upward movement of the drum member 50 is determined by the thickness of the mineral vein to be mined. Thus, the addition of the boom stabilizer 70 serves to ensure that the drum member 50 will be raised to the same vertical height for each shear cut to be made and this, in turn, provides for a substantially uniform ceiling height free of severe undulations, which is particularly desirable in the installation of roof belts and other devices to support the mine roof.

Figure 4:
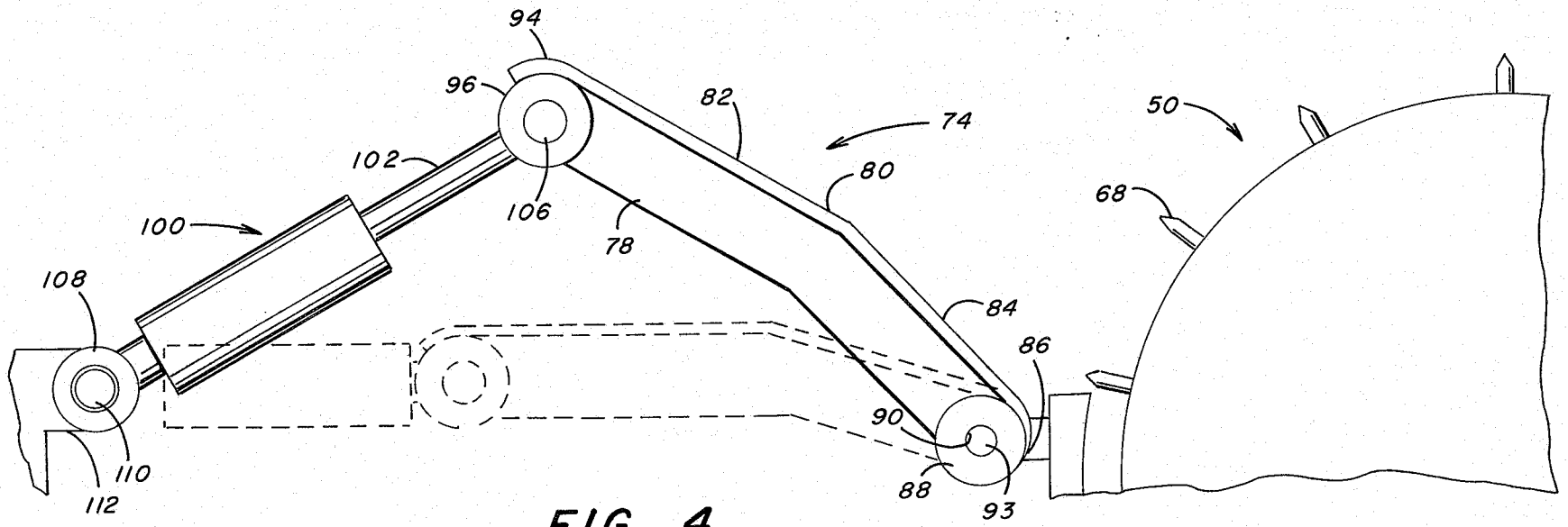
FIG. 4 is an enlarged side elevation of the boom stabilizer, illustrating a stabilizing plate positioned adjacent the drum member and pivoted upwardly in a first position on the boom by a piston cylinder assembly and pivoted downwardly to a second position shown in phantom.

As illustrated in greater detail in FIG. 4, the boom stabilizer 70 includes a stabilizing plate member 78 having an upper roof engaging surface 80. The roof engaging surface 80 has somewhat of an arcuate configuration having surface portions 82 and 84 angularly disposed forming the continuous roof engaging surface 80. Accordingly, the arcuate configuration of the stabilizing plate member 78 may be selected to meet the roof conditions and the thickness of the mineral vein to be mined. The plate member 78 has a forward edge portion 86 with a pair of spaced bosses 88 secured thereto as illustrated in FIGS. 2 and 4. Each boss 88 has a bore 90. The bosses 88 are aligned with a boss 92 on the boom member 26. The bore of boss 92 is aligned with the bores 90 to receive a pin 93 and thereby provide a pivotal connection of the plate forward edge 86 to the boom member 26. In a similar arrangement the plate member 78 also includes a rearward edge portion 94 and a pair of spaced bosses 96 having aligned bores 98 which are secured to the plate rearward edge 94.

The actuator mechanism 76 is preferably a hydraulically operated piston cylinder assembly 100 that includes an extensible piston rod 102 having an enlarged end portion 104. The end portion 104 is positioned between the bosses 96 of the plate member 78 so that the bores 98 are aligned with the bore of end portion 104. A pin 106 extends through the aligned bores to pivotally connect the piston rod 102 to the plate rearward edge 94. The piston cylinder assembly 100 includes a bracket 108 that is pivotally secured by a pin 110 to a pivot point 112 of the boom member 26. With this arrangement as the piston rod 102 extends from a retracted position, shown in phantom in FIG. 4, to the extended position, shown in solid, the cylinder pivots about the pivot point 112 as the stabilizing plate 78 pivots upwardly about the pivotal connection of the plate forward edge 86 to the boom member 26.

Preferably, the piston cylinder assembly 100 is operated to maintain the piston rod 102 in an extended position to ensure that the boom member 26 does not raise the drum member 50 beyond a preselected vertical height which is determined by the position of the stabilizing plate member 78. In accordance with the practice of the present invention, the assembly 100 is actuated to extend the piston rod 102 to raise the plate member 78 to a position where the plate rearward edge 94 is on a line tangent to the circular cutting path of the cutter bits 68. Thus, when the boom member 26 is raised to position the drum member 50 for sumping into the mine face adjacent the mine roof, upward movement of the drum member 50 into the roof will be prevented by the stabilizing plate member 78 abutting the mine roof. In this manner the plate member 78 stabilizes the boom member 26 restraining it from raising the drum member 50 beyond a preselected vertical height which is the height at which the mine roof is to be formed.

As the drum member 50 is sumped inwardly, the plate member 78 stabilizes the boom member 26 to maintain the drum member 50 at a preselected vertical height. When the sumping operation is completed the boom member 26 is pivoted downwardly to make a shear cut in the mine face and the stabilizing plate member 78 is removed from contact with the mine roof. Not only does the plate member 78 stabilize the boom member 26 during the sumping operation by restraining climbing of the drum member 50 into the mine roof, but in addition the plate member 78 serves to ensure that the drum member 50 is raised to the same vertical height each time a downward shear cut is made. Once the drum 50 is sumped inwardly and the downward shear cut is commenced, the boom stabilizer 70 becomes inactive but is retained in the selected elevated position. However, during tramming of the mining machine 10 the piston rod 102 may be retracted to lower the plate member 78 to the position illustrated in phantom in FIG. 4.

As above discussed it is preferred that the plate member 78 be pivoted upwardly to a position where the rearward edge portion 94 or a point on surface 82 or 84 lies on a line that is tangent to the peripheral cutting edge of the bits 68 opposite the mine roof 72. With the plate member 78 in this position the bits 68 remain removed from cutting engagement with the mine roof as illustrated in FIG. 3. By restraining upward movement of drum member 50, the drum member sumps into the mine face at the same elevation for each shear cut to form a substantially uniform mine roof free of undulations. This eliminates the problem of forming a mine roof having an irregular surface which occurs as a result of the drum member 50 climbing into the roof during the sumping operation. During the sumping operation the drum motors 52 and 54 are relieved of the additional load applied when the cutter bits 68 engage the mine roof as well as the mine face. With the stabilizing plate member 78 engaging the mine roof, the plate serves as a secondary reaction point for balancing loads applied to the boom member 26. A pressure relief valve may be operatively associated with the piston cylinder assembly 100 to relieve the fluid pressure in the cylinder when forces applied thereto through the stabilizing plate exceed a preselected maximum to permit the piston rod 102 to collapse and remove the plate member 78 from contact with the mine roof. This prevents rupture of the hydraulic lines to the assembly 100 in the event it should be overloaded.

According to the provisions of the patent statutes, we have explained the principle, preferred construction and mode of operation of our invention and have illustrated and described what we now consider to represent its best embodiments. However, it should be understood that, within the scope of the appended claims, the invention may be practiced otherwise than as specifically illustrated and described.

We claim:

1. A boom stabilizer for an underground mining machine comprising,
   - a mobile body portion,
   - a boom member pivotally secured to said body portion and extending forwardly therefrom,
   - a material dislodging apparatus rotatably mounted on the front of said boom member,
   - cutting elements secured to said material dislodging apparatus and extending outwardly therefrom,
   - stabilizing means pivotally connected to said boom member adjacent to said material dislodging apparatus for engaging the mine roof to maintain said cutting elements displaced from engaging said mine roof as said dislodging apparatus sumps into the mine face adjacent said mine roof, and
   - actuator means connected to said stabilizing means and mounted on said boom member for raising and lowering said stabilizing means, said actuator means operable to raise a portion of said stabilizing means to a location above said cutting elements so that said stabilizing means prevents said cutting elements from dislodging material from the mine roof.

2. A boom stabilizer for an underground mining machine as set forth in claim 1 which includes,
   - said stabilizing means being pivotally connected at one end portion to the forward edge of said boom member rearwardly of said material dislodging apparatus,
   - said stabilizing means extending rearwardly on said boom member,
   - said stabilizing means being pivotally connected at the opposite end portion to said actuator means, and
   - said actuator means being pivotally mounted on said boom member.

3. A boom stabilizer for an underground mining machine as set forth in claim 1 which includes,
   - said stabilizing means having a roof engaging assembly, and
   - said actuator means being operable to pivot said stabilizing means upwardly on said boom member such that when said roof engaging assembly is positioned in contact with the mine roof said cutting elements are spaced from cutting relation with the mine roof.

4. A boom stabilizer for an underground mining machine as set forth in claim 1 which includes,
   - said stabilizing means having an upper surface arranged to be positioned in abutting relation with the mine roof when said material dislodging apparatus is raised to a position adjacent the mine roof, and
   - said actuator means being operable to maintain said upper surface in contact with the mine roof and positioned on a line tangent to the cutting path of said cutting elements adjacent the mine roof.

5. A boom stabilizer for an underground mining machine as set forth in claim 4 which includes, said stabilizing means upper surface having an arcuate configuration arranged to abut the mine roof with said boom member raised to a preselected vertical height to maintain said cutting elements displaced from the mine roof to prevent dislodging of material from the mine roof as said material dislodging apparatus is sumped into the mine face.

6. A boom stabilizer for an underground mining machine as set forth in claim 1 which includes, said stabilizing means extending rearwardly of said material dislodging apparatus and positioned at a preselected transverse location on said boom member.

7. A boom stabilizer for an underground mining machine as set forth in claim 1 in which said stabilizing means includes, an elongated stabilizing plate having a pair of bosses secured to the end portions thereof, a pivot connection on the forward transverse edge of said boom member, means for pivotally securing one pair of said bosses to said pivot connection, said actuator means being pivotally connected at one end portion to said boom member and at the other end portion to the other of said pair of bosses of said stabilizing plate, and said actuator means being operable upon actuation to pivot said stabilizing plate about the connection thereof to said boom member and vertically raise said stabilizing plate through an arcuate path to a preselected vertical height for engaging the mine roof when said material dislodging apparatus is raised to a position adjacent the mine roof by said boom member.

8. A boom stabilizer for an underground mining machine as set forth in claim 7 in which said stabilizing plate includes, an upper roof engaging surface having an arcuate configuration, and said roof engaging surface arranged to be positioned above said boom member on a line tangent to the peripheral cutting edge of the cutting elements located at the top os said material dislodging apparatus.

9. A boom stabilizer for an underground mining machine as set forth in claim 1 in which said actuator means includes, a piston cylinder assembly having an extensable piston rod, said piston cylinder assembly being pivotally mounted on said boom member, said piston rod having an end portion pivotally connected to said stabilizing means, and said piston cylinder assembly being operable upon actuation to extend and retract said piston rod to pivot said stabilizing means on said boom member and raise said stabilizing means to a preselected height above said boom member.

* * * * *